US006520058B2

(12) United States Patent
Nakajima et al.

(10) Patent No.: US 6,520,058 B2
(45) Date of Patent: Feb. 18, 2003

(54) THREE-SIDE TRIMMER

(75) Inventors: Akira Nakajima, Shiga (JP); Toyoki Takeuchi, Shiga (JP); Tomonori Yachi, Uji (JP)

(73) Assignee: Horizon International Inc., Shiga (JP)

( * ) Notice: Subject to any disclaimer, the term of this patent is extended or adjusted under 35 U.S.C. 154(b) by 140 days.

(21) Appl. No.: 09/799,393

(22) Filed: Mar. 5, 2001

(65) Prior Publication Data

US 2001/0023630 A1 Sep. 27, 2001

(30) Foreign Application Priority Data

Mar. 8, 2000 (JP) ..... 2000-062804

(51) Int. Cl.[7] ..... B26D 1/03; B26D 5/20; B26D 7/02

(52) U.S. Cl. ..... 83/206; 83/213; 83/255; 83/277; 83/452; 83/646; 83/934

(58) Field of Search ..... 83/206, 207, 213, 83/214, 282, 451, 452, 453, 646, 598, 597, 607, 934, 255, 276, 277, 640, 620

(56) References Cited

U.S. PATENT DOCUMENTS

| | | | | | |
|---|---|---|---|---|---|
| 1,076,726 | A | * | 10/1913 | Welch | 33/32.1 |
| 1,327,915 | A | * | 1/1920 | Kast | 270/52.17 |
| 2,562,938 | A | * | 8/1951 | Moyer | 83/255 |
| 3,424,044 | A | * | 1/1969 | Thumim et al. | 493/372 |
| 3,528,332 | A | * | 9/1970 | Thumim et al. | 83/214 |
| 3,732,766 | A | * | 5/1973 | McCain et al. | 83/104 |
| 3,733,947 | A | * | 5/1973 | Bryson et al. | 414/19 |
| 3,811,350 | A | * | 5/1974 | Marciniak | 83/255 |
| 3,841,182 | A | * | 10/1974 | Cosgrove et al. | 83/255 |
| 4,202,232 | A | * | 5/1980 | Muller | 83/519 |
| 4,300,427 | A | | 11/1981 | Rathert | 83/519 |
| 4,505,173 | A | | 3/1985 | Hartlage | 83/112 |
| 4,516,455 | A | * | 5/1985 | Peters | 83/519 |
| 4,615,249 | A | * | 10/1986 | Geiser | 83/221 |
| 4,922,773 | A | * | 5/1990 | Ito | 198/345.1 |
| 5,259,285 | A | * | 11/1993 | Uchida | 83/934 |
| 5,694,823 | A | * | 12/1997 | Westra et al. | 83/206 |

FOREIGN PATENT DOCUMENTS

| | | |
|---|---|---|
| EP | 0941817 A1 | 9/1999 |
| JP | 09-094796 | 2/1995 |

* cited by examiner

*Primary Examiner*—Allan N. Shoap
*Assistant Examiner*—Stephen Choi
(74) *Attorney, Agent, or Firm*—Hodgson Russ LLP

(57) ABSTRACT

A top edge trimming cutter, a bottom edge trimming cutter and a front edge trimming cutter are arranged to have predetermined distances from one another so as not to cause mechanical interference. The top edge trimming cutter, a first table element, a first blade receiving plate and a first pressing plate pressing a bound material against the first table element are attached to a first frame element. The bottom edge trimming cutter, a second table element, a second blade receiving plate and a second pressing plate pressing the bound material against the second table element are attached to a second frame element. Relative movement of the first and second frame elements effects relative movement of the top edge trimming cutter and the bottom edge trimming cutter, relative movement of corresponding first and second blade receiving plates and relative movement of corresponding first and second pressing plates.

8 Claims, 7 Drawing Sheets

(a)

(b)

THREE-SIDE TRIMMER

FIELD OF THE INVENTION

The present invention relates to a three-side trimmer used for book binding process or the like.

BACKGROUND OF THE INVENTION

A three-side trimmer for cutting (or trimming) the three sides, i.e., the top edge, the bottom edge and the front edge of a bound material is often used for finishing book binding in book binding process. The three-side trimmer is comprised of, as schematically shown in FIG. 7, a top edge trimming cutter 1 for cutting the top edge of a bound material to be trimmed (not shown), a bottom edge trimming cutter 2 for cutting the bottom edge of the bound material, a front edge trimming cutter 3 for cutting the front edge of the bound material, a cutting table 4 on which the bound material is supported and a pressing plate 5 pressing and fixing the bound material while cutting the bound material.

The trimming cutters 1, 2 and 3 are arranged substantially in a U-shaped manner above the cutting table 4 along the upper surface peripheral edge of the table 4. The top edge trimming cutter 1 and the bottom edge trimming cutter 2 are arranged to face each other in parallel with each other, with a distance corresponding to the distance between the top and bottom of the bound material from each other. The front edge trimming cutter 3 is arranged at right angle with respect to the top edge trimming cutter 1 and the bottom edge trimming cutter 2. Each of the trimming cutters 1, 2 and 3 is attached to a frame (not shown) for upward and downward movement in oblique direction by a drive. Each of the trimming cutters 1, 2 and 3 executes upward and downward movement between a wait position at which it is located above the upper surface peripheral edge of the cutting table 4 and a cutting position at which it is press-contacted with the upper surface peripheral edge of the cutting table 4.

Elongate blade receiving plates 4*a*, 4*b* and 4*c* made of, for example, hard rubber and receiving the corresponding trimming cutters are fixed in peripheral regions in such a manner that- they are press-contacted by the trimming cutters 1, 2 and 3 located at the cutting positions on the upper surface of the cutting table 4. Further, a pressing plate 5 is detachably attached to a tool which is ascended and descended by an elevator or the like, which is not shown.

During a cutting operation, the bound material is put on the upper surface of the cutting table 4 and the top edge, bottom edge and front edge thereof are positioned on the upper surfaces of the corresponding blade receiving plates 4*a*, 4*b* and 4*c*, respectively. Then the bound material is pressed by the pressing plate 5 and fixed to the cutting table 4. Thereafter, the top edge trimming cutter 1 and the bottom edge trimming cutter 2 are simultaneously descended from the wait positions to the cutting positions, the top edge and bottom edge of the bound material are cut and the top edge trimming cutter 1 and the bottom edge trimming cutter 2 are ascended to the wait positions. Then, the front edge trimming cutter 3 is descended from the wait position to the cutting position and the front edge of the bound material is cut. After the cutting operation, the front edge trimming cutter 3 is ascended to the wait position. Alternatively, after the bound material is fixed to the cutting table 4 by the pressing plate 5, the front edge trimming cutter 3 may move upwardly and downwardly so as to first cut the front edge of the bound material and then the top edge trimming cutter 1 and the bottom edge trimming cutter 2 may be simultaneously moved upwardly and downwardly to cut the top edge and bottom edge of the bound material.

In case of the conventional three-side trimmer, if the size of the bound material is changed, the distance between the top edge trimming cutter 1 and the bottom edge trimming cutter 2 needs to be changed. To do so, the top edge trimming cutter 1 and the bottom edge trimming cutter 2 are normally moved to be close to or away from each other in a direction parallel to the length of the front edge trimming cutter 3, thereby making the distance changeable. If the distance between the top edge trimming cutter 1 and the bottom edge trimming cutter 2 is changed, it is necessary to change the positions of the blade receiving plates 4*a* and 4*b* fixed to the cutting table 4. Due to this, cutting tables having sizes corresponding to the sizes of bound materials are prepared and appropriately replaced. However, the cutting table 4 is located just under the respective trimming cutters, so that a cutting table replacement operation is quite dangerous. Considering this, according to an improved three-side trimmer, a blade receiving plate 4*c* relating to a front edge trimming cutter 3 is fixed to a base, a cutting table 4 is constituted out of a pair of plate elements which can execute movement in approaching or separating directions parallel to the length of the blade receiving plate 4*c*, and a blade receiving plate 4*a* relating to a top edge trimming cutter 1 and a blade receiving plate 4*b* relating to a bottom edge trimming cutter 2 are fixed to the paired plate elements, respectively. By doing so, it is possible to change the positions of the blade receiving plates 4*a* and 4*b* without replacing the cutting table.

In the above-stated three-side trimmer, a bound material is located at a fixed position on the paired plate elements, at which position the three edges, i.e., the top edge, bottom edge and front edge of the bound material are cut. As a result, the front edge trimming. cutter 3 mechanically interferes with the top edge trimming cutter 1 and the bottom edge trimming cutter 2 if the blade 3 operates simultaneously with the top edge trimming cutter 1 and the bottom edge trimming cutter 2. To avoid this interference, the upward and downward movement of the front edge trimming cutter 3 is conducted at a predetermined time after the upward and downward movement of the top edge trimming cutter 1 and the bottom edge trimming cutter 2.

Nevertheless, because of the wear and the like of the constituent elements of the three-side trimmer, the staggered timing of the upward and downward movement of the front edge trimming cutter 3 with respect to the top edge trimming cutter 1 and the bottom edge trimming cutter 2 is shifted, .with the result that the front edge trimming cutter 3 interferes with the top edge trimming cutter 1 and the bottom edge trimming cutter 2 and the three-side trimmer is disadvantageously broken. Further, if the size of the bound material is changed, it is necessary to replace the pressing plate 5 in accordance.with the changed size. The replacement operation for the pressing plate 5 is, however, carried out in a narrow region surrounded by the respective trimming cutters 1, 2 and 3. Due to this, the operation is required to be carried out with the greatest possible care and is disadvantageously difficult to pursue.

SUMMARY OF THE INVENTION

It is, therefore, an object of the present invention to provide a three-side trimmer capable of preventing the mechanical interference of a front edge trimming cutter with a top edge trimming cutter and a bottom edge trimming cutter during operation and capable of dealing with different sizes of bound materials without the need to replace a pressing plate.

According to the present invention, the above object is attained by providing a three-side trimmer comprising: a frame; a cutting table supporting a bound material to be trimmed thereon; a top edge trimming cutter attached to the frame for upward and downward movement, and cutting a top edge of the bound material; a bottom edge trimming cutter attached to the frame for upward and downward movement and in parallel with the top edge trimming cutter, and cutting a bottom edge of the bound material; a front edge trimming cutter attached to the frame for upward and downward movement at right angle with respect to the top edge trimming cutter and the bottom edge trimming cutter with predetermined distances from one ends of the top edge trimming cutter and the bottom edge trimming cutter, and cutting a front edge of the bound material; a drive mechanism for effecting the upward and downward movement of the top edge trimming cutter, the bottom edge trimming cutter and the front edge trimming cutter; first and second blade receiving plates attached to face the top edge trimming cutter and the bottom edge trimming cutter right under the top edge trimming cutter and the bottom edge trimming cutter, respectively on the cutting table for receiving blade edges of the top edge trimming cutter and the bottom edge trimming cutter, respectively; a third blade receiving plate attached to face the front edge trimming cutter right under the front edge trimming cutter on said cutting table for receiving a blade edge of said front edge trimming cutter; a pressing plate attached to the frame for upward and downward movement, and pressing the bound material against said cutting table; the top edge trimming cutter and the bottom edge trimming cutter being arranged to move relatively to each other in a direction parallel to the length of the front edge trimming cutter in accordance with a size of the bound material; the cutting table comprising first and second table elements movable relatively to each other along the direction of movement of the top edge trimming cutter and the bottom edge trimming cutter, and a stationary third table element; first and second blade receiving plates attached to the first and second table elements, respectively, and a third blade receiving plate attached to the third table element; and a chuck mechanism gripping the bound material to be trimmed so as to move the bound material between at least two positions of a first cutting position at which the bound material is cut by the top edge trimming cutter and the bottom edge trimming cutter, and a second cutting position at which the bound material is cut by the front edge trimming cutter.

According to a preferred embodiment of the present invention, the frame comprises first and second frame elements movable relatively to each other along the direction of movement of the top edge trimming cutter and the bottom edge trimming cutter and a stationary third frame element. The top edge trimming cutter, the first table element and a first pressing plate pressing the bound material against the first table element and making an elevation movement are attached to the first frame element. The bottom edge trimming cutter, the second table element and a second pressing plate pressing the bound material against the second table element and making an elevation movement are attached to the second frame element. Relative movement of the first and second frame elements effect relative movement of the top edge trimming cutter and the bottom edge trimming cutter, relative movement of corresponding the first and second blade receiving plates and relative movement of.corresponding the first and second pressing plates.

According to another preferred embodiment of the present invention, the relative movement of the first and second frame elements are effected by movement of the first and second frame elements in opposite directions or by movement of one of the first and second frame elements with respect to the other one of said first and second frame elements of its rest position.

According to further preferred embodiment of the present invention, the chuck mechanism is provided with an auxiliary pressing plate pressing the bound material against the third table element.

According to further preferred embodiment of the present invention, the chuck mechanism comprises a grip head consisting of a fixed block and a movable block coupled to the fixed block through a vertical screw shaft so as to ascend and descend by rotation of the screw shaft, a motor attached to the lower portion of the fixed block for rotating the vertical screw shaft about its axis, a horizontal screw shaft and a guide rod attached to the frame and arranged parallel with each other along a direction parallel to the length of the top edge trimming cutter and bottom edge trimming cutter. The fixed block is provided with two penetrating holes in a direction parallel to the length of the top edge trimming cutter and bottom edge trimming cutter. One of the penetrating holes is provided with an internal thread for engaging with the horizontal screw shaft. The screw shaft is screwed into one of the penetrating holes and the guide rod is inserted into other of the penetrating holes. The chuck mechanism further comprises a shaft driving motor fixed to the frame, a first pulley mounted on one end of the screw shaft, a second pulley mounted on a drive shaft of the shaft driving motor, and an endless belt engaged with the first and second pulleys. Thus the grip head grips the bound material between its fixed block and movable block, and executes slide movement along the guide rod at least between the first cutting position and the second cutting position.

DESCRIPTION OF THE PREFERRED EMBODIMENTS

Figure 1:
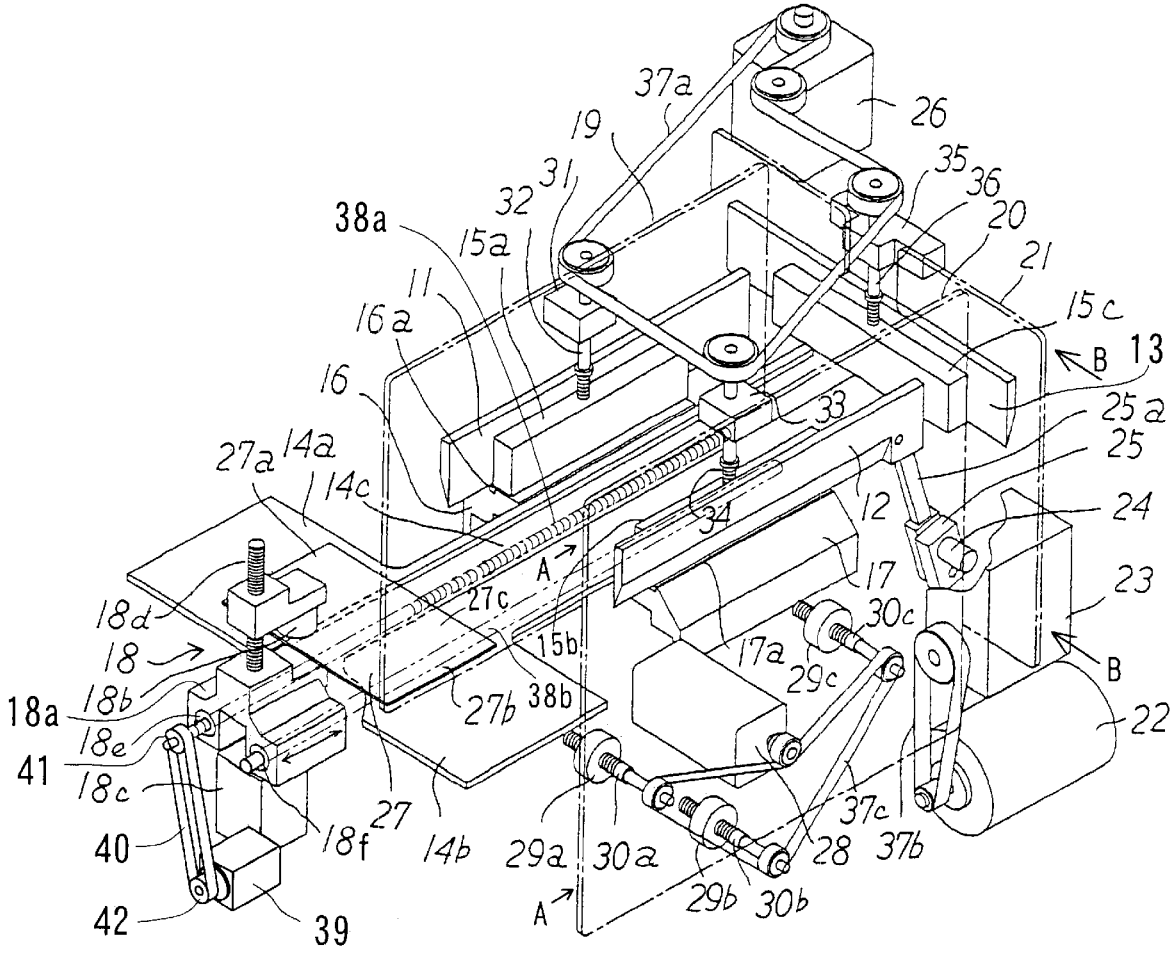
FIG. 1 is a perspective view showing schematically the constitution of a three-side trimmer in the first embodiment of the present invention.
Figure 2:
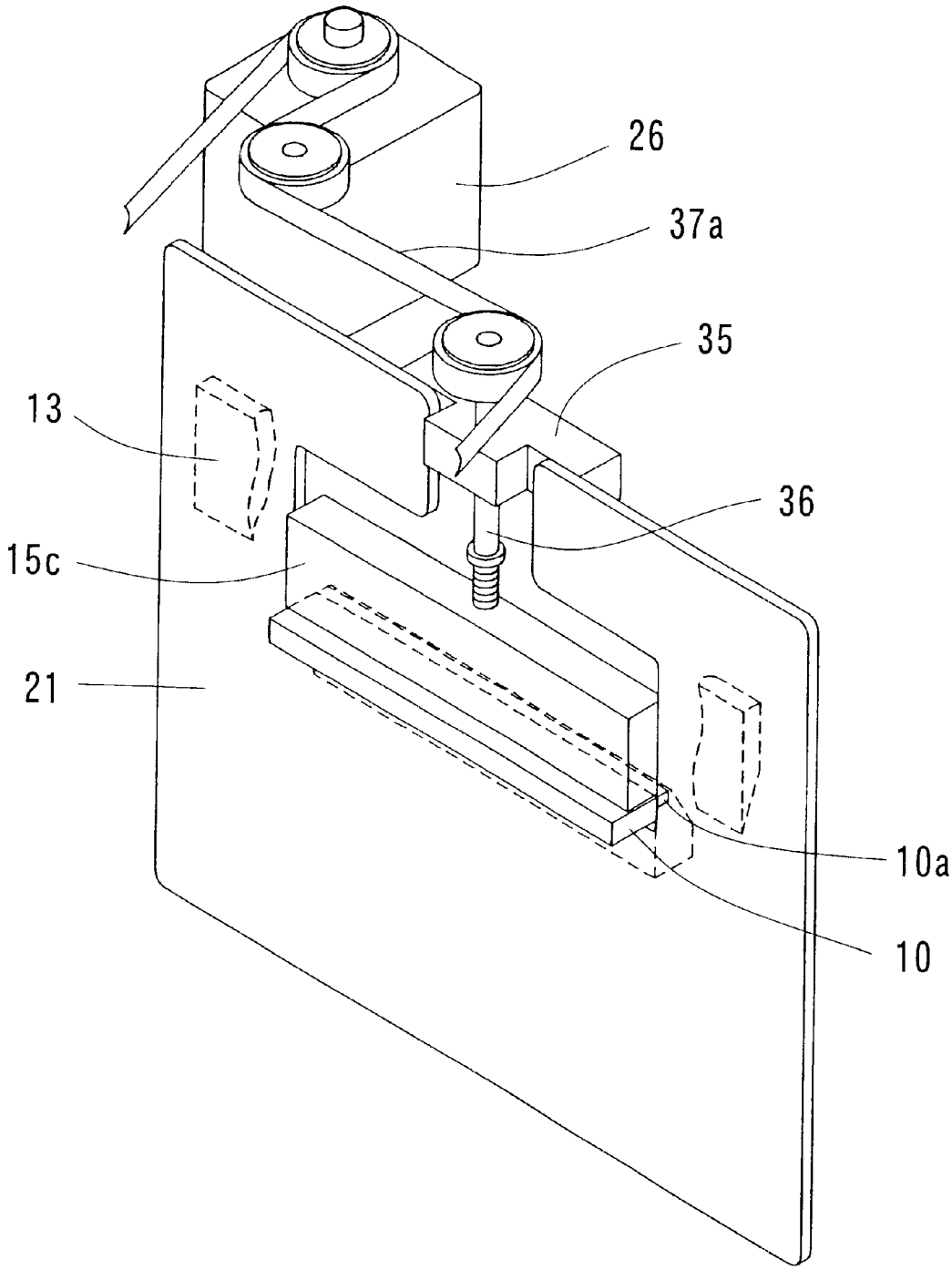
FIG. 2 is a perspective view showing schematically the constitution of a third frame element of the three-side trimmer shown in FIG. 1.
Figure 3:
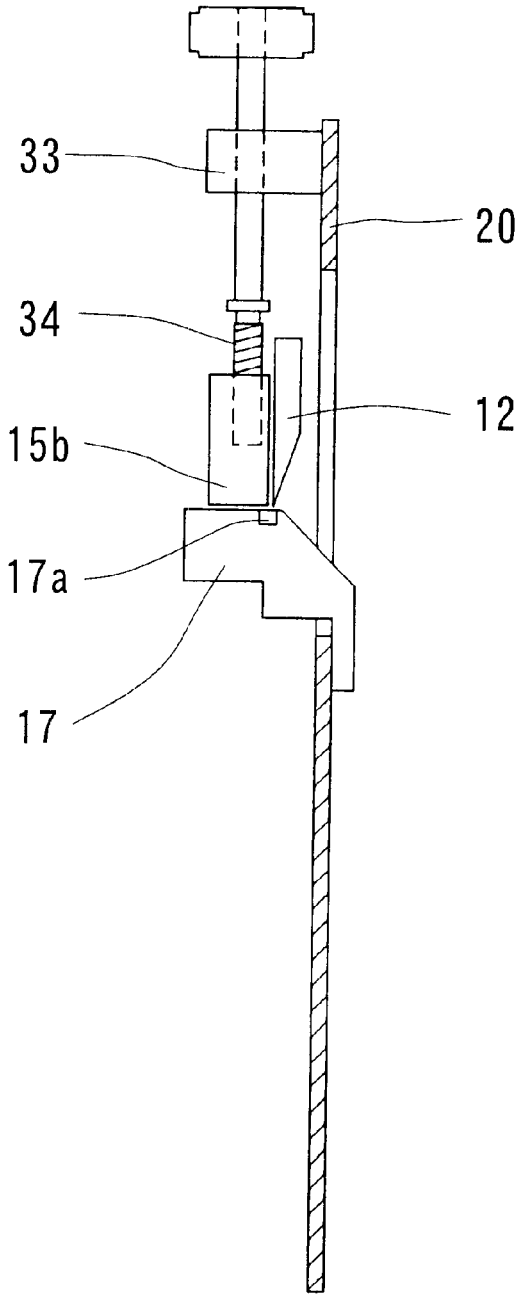
FIG. 3 is a side view in the direction of the arrow A in FIG. 1.
Figure 4:
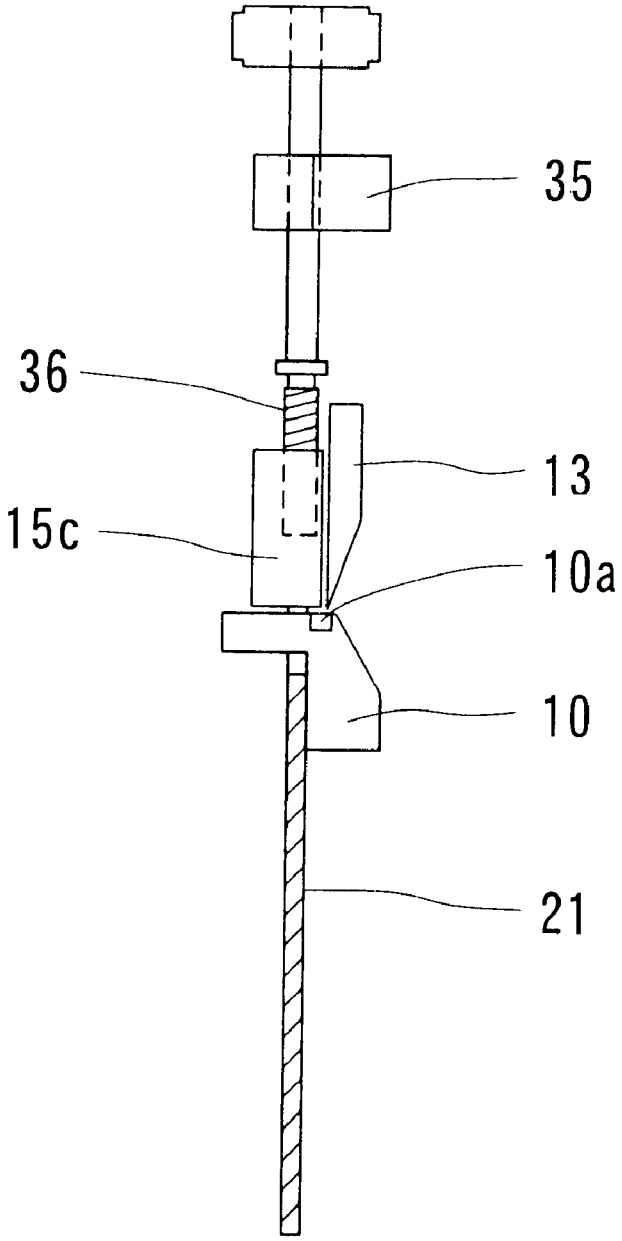
FIG. 4 is a side view in the direction of the arrow B in FIG. 1.

The preferred embodiments of the present invention will be described hereinafter with reference to the accompanying drawings. FIG. 1 is a perspective view showing schematically the constitution of a three-side trimmer in the first embodiment according to the present invention. FIG. 2 is a perspective view showing schematically the constitution of a third frame element of the three-side trimmer shown in FIG. 1. FIG. 3 is a side view in the direction of the arrow A in FIG. 1 and FIG. 4 is a side view in the direction of the arrow B in FIG. 1.

In FIGS. 1–4, the reference numeral 11 denotes a top edge trimming cutter cutting the top edge 27*a* of a bound material 27 to be trimmed, the reference numeral 12 denotes a bottom edge trimming cutter located in parallel to the top edge trimming cutter 11 and cutting the bottom edge 27*b* of the bound material 27, the reference numeral 13 denotes a front edge trimming cutter located at right angle with respect to the top edge trimming cutter 11 and the bottom edge trimming cutter 12 with predetermined distances from one ends of the top edge trimming cutter 11 and the bottom edge trimming cutter 12 and cutting the front edge 27*c* of the bound material 27. The top edge trimming cutter 11 and the bottom edge trimming cutter. 12 are arranged so that they can move relatively to each other in a direction parallel to the length of the front edge trimming cutter 13 in accordance with the size of the bound material 27.

A cutting table supporting the bound material 27 thereon is arranged right under the top edge trimming cutter 11, the bottom edge trimming cutter 12 and the front edge trimming cutter 13. The cutting table consists of the first table element 16 and the second table element 17 which can move relatively to each other along the direction of movement of the top edge trimming cutter 11 and the bottom edge trimming cutter 12, respectively, and the stationary, third table element 10, 14*a* and 14*b*. The third table element 10, 14*a* and 14*b* further consist of the first portion 10, the second portion 14*a* and the third portion 14*b*.

The first blade receiving plate 16*a* receiving the blade edge of the top edge trimming cutter 11 is attached to face the top edge trimming cutter 11 on the first table element 16. The second blade receiving plate 17*a* receiving the blade edge of the bottom edge trimming cutter 12 is attached to face the bottom edge trimming cutter 12 on the second table element 17. The third blade receiving plate 10*a* receiving the blade edge of the front edge trimming cutter 13 is attached to face the front edge trimming cutter 13 on the first portion 10 of the third table element.

The three-side trimmer according to the present invention also comprises a frame. The frame consists of the first frame element 19 and the second frame element which can move relatively to each other along the direction of movement of the top edge trimming cutter 11 and the bottom edge trimming cutter 12, respectively, and the stationary third frame element 21.

The first table element 16 and a support member 31 are attached to the first frame element 19 and the top edge trimming cutter 11 is also attached thereto for upward and downward movement in oblique direction. A vertical screw shaft 32 is rotatably supported by the support member 31 and the first pressing plate 15*a* is attached to the screw shaft 32 for pressing the bound material 27 against the first table element 16. When the screw shaft 32 rotates, the first pressing plate 15*a* ascends and descends. The second table element 17 and a support member 33 are attached to the second frame element 20 and the bottom edge trimming cutter 12 is also attached thereto for upward and downward movement in oblique direction. A vertical screw shaft 34 is rotatably supported by the support member 33 and the second pressing plate 15*b* is attached to the screw shaft 34 for pressing the bound material 27 against the second table element 17. When the screw shaft 34 rotates, the second pressing plate 15*b* ascends and descends.

The first portion 10 of the third table element and a support member 35 are attached to the third frame element 21 and the front edge trimming cutter 13 is also attached thereto for upward and downward movement in oblique direction. A vertical screw shaft 36 is rotatably supported by the support member 35 and the third pressing plate 15*c* is attached to the screw shaft 36 for pressing the bound material 27 against the first portion 10 of the third table element.

Pulleys are fixed to the upper ends of the respective screw shafts 32, 34 and 36 and an endless belt 37*a* is engaged with the pulleys and rotated by a pressing plate drive motor 26.

One end of the bottom edge trimming cutter 12 is pivotally coupled to one end of a trimming cutter drive rod 25*a*. The other end of the trimming cutter drive rod 25*a* is coupled to the crank 25 of the horizontal output shaft 24 of a drive reduction gear 23. The output shaft 24 is rotatably supported by the second frame element 20. When a trimming cutter drive motor 22 is driven to rotate the output shaft 24 once, the bottom edge trimming cutter 12 is guided by a well-known guide mechanism, which is not shown, and executes upward and downward movement by one cycle in oblique direction. Mechanisms for elevating the top edge trimming cutter 11 and the front edge trimming cutter 13 have the same constitution as that of the mechanism for the bottom edge trimming cutter 12. It is noted that an output shaft relating to the top edge trimming cutter 11 is common to the output shaft 24 relating to the bottom edge trimming cutter 12, while an output shaft relating to the front edge trimming cutter 13 is a different, independent output shaft.

Nuts 29*a* to 29*c* are attached to the second frame element 20 and horizontal screw shafts 30*a* to 30*c* are screwed into the respective nuts 29*a* to 29*c*. Pulleys are attached to the tip end portions of the respective screw shafts 30*a* to 30*c*. An endless belt 37*c* is engaged with the pulleys and a pulley attached to the rotary shaft of a frame drive motor 28. When the frame drive motor 28 is driven, the respective pulleys and, therefore, the respective screw shafts 30*a* to 30*c* rotate, the second frame element and, therefore, the second table element 17, the bottom edge trimming cutter 12 and the second blade receiving plate 17*a* attached to the second frame element 20 move to close to or away from the first frame element 19 and, therefore, the first table element 16, the top edge trimming cutter 11 and the first blade receiving plate 16*a* attached to the first frame element which are arranged to face the second frame element 20, the second table element 17, the bottom edge trimming cutter 12 and the second blade receiving plate 17*a*, respectively.

In this way, the relative movement of the first and second frame elements 19 and 20 effect the relative movement of the top edge trimming cutter 11 and the bottom edge trimming cutter 12, those of the corresponding first and second blade receiving plates 16*a* and 17*a* and those of the corresponding first pressing plates 15*a* and 15*b*.

In the following description, the first frame element 19 and the first table element 16, the top edge trimming cutter 11 and the first blade receiving plate 16*a* attached to the first frame element 19 are referred to as "a top edge cutting unit 19" as a whole. The second frame element 20 and the second table element 17, the bottom edge trimming cutter 12 and the second blade receiving plate 17*a* attached to the second frame element 20 are referred to as "a bottom edge cutting unit 20" as a whole. The third frame element 21 and the first portion 10 of the third table element, the front edge trimming cutter 13 and the third blade receiving plate 10*a* attached to the third frame element are referred to as "a front edge cutting unit 21 as a whole.

The front edge cutting unit 21 is arranged to have a predetermined distance from one end of the top edge cutting unit 19 and that of the bottom edge cutting unit 20. By so arranging, even if the trimming cutters 11, 12 and 13 and the respective pressing plates 15*a* to 15*c* operate simultaneously, they do not interfere with one another.

The second portion 14*a* of the third table element linearly extends from the front edge cutting unit 21 in a direction parallel to the length of the top edge cutting unit 19 between the top edge cutting unit 19 and the bottom edge cutting unit 20 and then extends at right angle at a position exceeding the end of the.top edge cutting unit 19 toward the outside of the top edge cutting unit 19. The third portion 14*b* linearly extends from the front edge cutting unit 21 in a direction parallel to the length of the bottom edge cutting unit 20 and then extends at right angle at a position exceeding the end of the bottom edge cutting unit 20 toward the outside of the bottom edge cutting unit 20. The regions of the second portion 14*a* and the third portion 14*b* extending at right angle toward the outside of the top edge cutting unit 19 and the bottom edge cutting unit 20, respectively, are supplied with the bound material and serve as a bound material supply position. A gap 14*c* is formed between the second portion 14*a* and the third portion 14*b* in the direction parallel to the length of the top edge trimming cutter 11 and the bottom edge trimming cutter 12.

Figure 5:
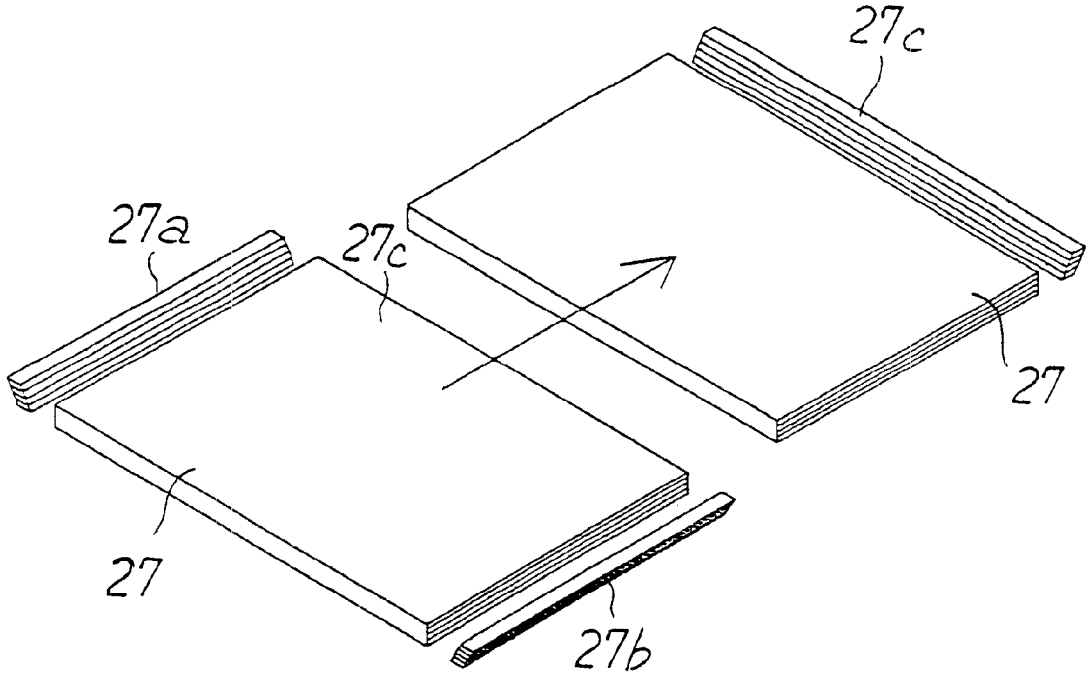
FIG. 5 is a perspective view showing the cutting position of the three-side trimmer shown in FIG. 1.

The three-side trimmer according to the present invention further comprises a chuck mechanism 18 gripping the bound material 27 supplied to the bound material supply position so as to move the bound material 27 among.the bound material supply position, the first cutting position at which the top and bottom edges 27*a* and 27*b* of the bound material 27 are cut by the top edge trimming cutter 11 and the bottom edge trimming cutter 12, respectively, and the second cutting position at which the front edge 27*c* of the bound material 27 is cut by the front edge trimming cutter 13 (see FIG. 5).

The chuck mechanism 18 has a grip head consisting of a fixed block 18*a* and a movable block 18*b* coupled to the fixed block 18*a* through a vertical screw shaft 18*d*. The screw shaft 18*d* rotates with a drive shaft of a motor 18*c* attached to the lower portion of the fixed block 18*a* by the motor 18*c*. The movable block 18*b* is ascended and descended by the rotation of the screw shaft 18*d*, whereby the bound material 27 can be put between the fixed block 18*a* and the movable block 18*b*. The chuck mechanism 18 also has a horizontal screw shaft 38*a* and a guide rod 38*b* which are attached to the frame and arranged parallel with each other along the direction parallel to the length of the gap 14*c*. Penetrating holes 18*e* and 18*f* are formed in the fixed block 18*a* in a direction parallel to the length of the gap 14*c*. The penetrating hole 18*e* is provided with an internal thread for engaging with the horizontal screw shaft 38*a*. The screw shaft 38*a* is screwed into the penetrating hole 18*e* and the guide rod 38*b* is inserted into the penetrating hole 18*f*. The chuck mechanism 18 further comprises a shaft driving motor 39 fixed to the frame, a first pulley 41 mounted on one end of the screw shaft 38*a*, a second pulley 42 mounted on a drive shaft of the shaft driving motor 39 and an endless belt 40 engaged with the pulleys 41 and 42. The grip head executes slide movement within the gap 14*c* along the guide rod 38*b* among the bound material supply position, the first cutting position and the second cutting position.

Figure 6:
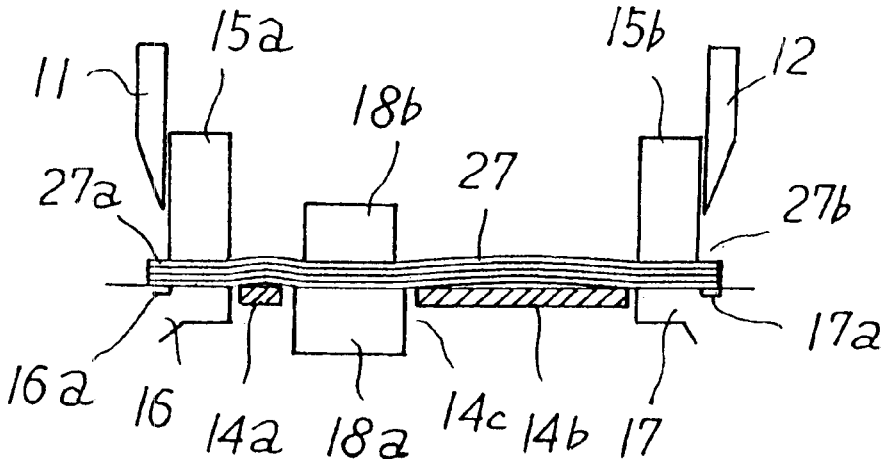
FIG. 6 is a cross-sectional view showing schematically the constitution of the pressing plate of the three-side trimmer shown in FIG. 1.
Figure 6:
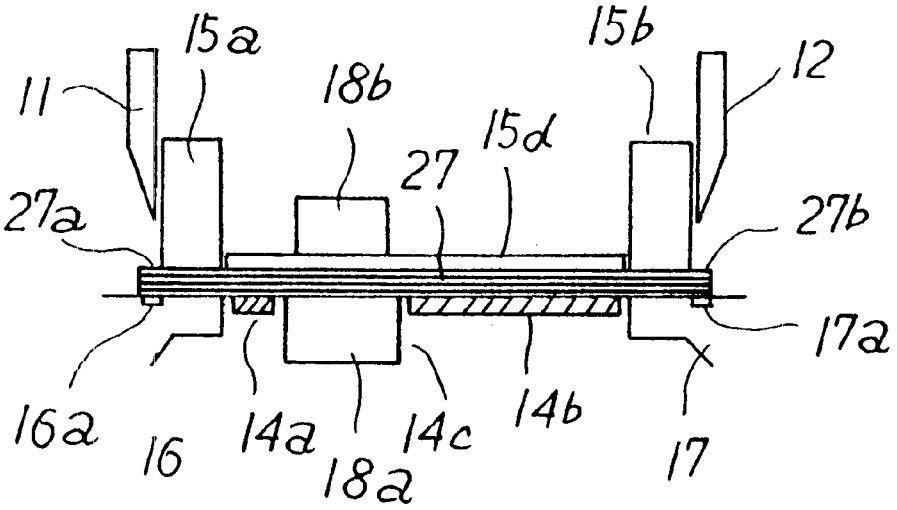
Figure 7:
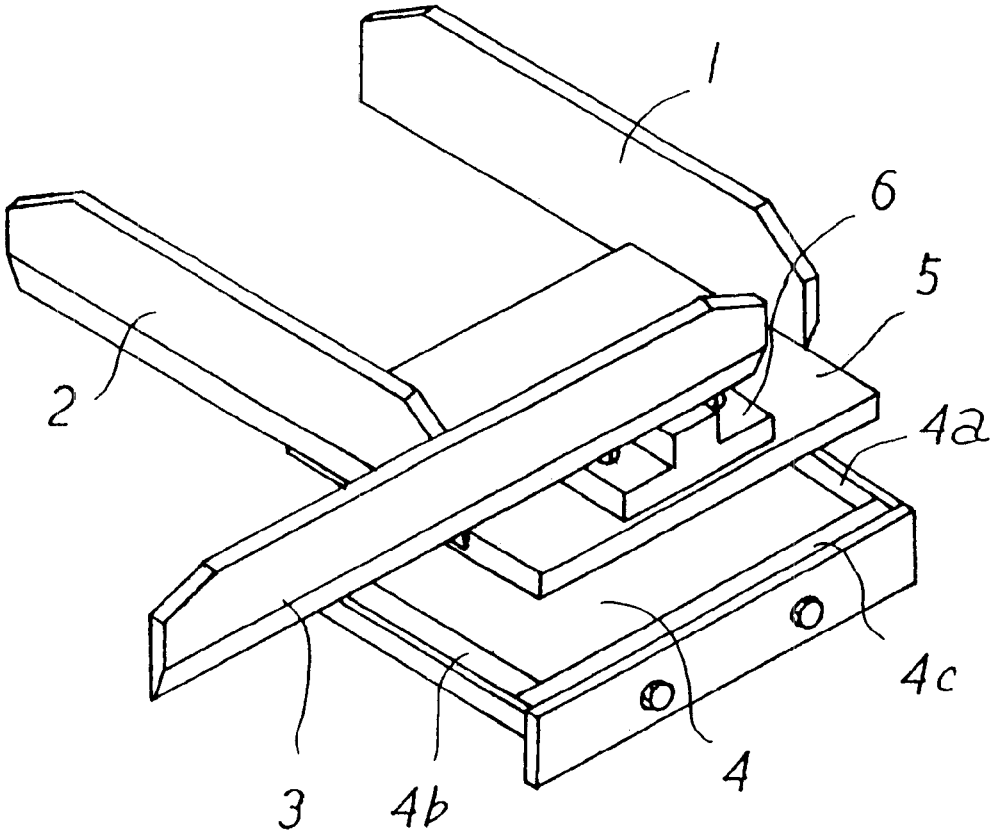
FIG. 7 (PRIOR ART)
FIG. 7 is a perspective view showing schematically the constitution of a conventional three-side trimmer.

If the bound material is corrugated as shown in FIG. 6(*a*), a flat auxiliary pressing plate 15*d* is fixed to the movable block 18*b* as shown in FIG. 6(*b*). In this case, the replacement of the auxiliary pressing plate 15*d* is carried out outside of a region surrounded by the cutting units, thereby ensuring a safe, easy replacement operation. It is also possible to cut a press board together with the bound material with the press board and the bound material 27 put between the blocks of the chuck mechanism 18 and to use the press board which has been cut as auxiliary pressing plate. In this case, the end portions of both the top and bottom edges are arranged below the pressing plates 15*a* and 15*b*.

In the three-side trimmer according.to the present invention, when the bound material is cut, the frame drive motor 28 is drive and the bottom edge cutting unit 20 is moved to the top edge cutting unit 19, whereby the distance between the top edge cutting unit 19 and the bottom edge cutting unit 20 is set to correspond to the dimensions of the top and bottom edges of the bound material. The bound material 27 is supplied to the bound material supply position, positioned to be trimmed later and gripped by the grip head of the chuck mechanism 18. The grip head gripping the bound material 27 moves to the first cutting position and stops. At this moment, the top edge 27*a* of the bound material 27 is located on the first blade receiving plate 16*a* of the first table element 16 and the bottom edge 27*b* thereof is located on the second blade receiving plate 17*a* of the second table element 17.

Next, the pressing plate drive motor 26 is driven to descend the first and second pressing plates 15*a* and 15*b*, the portion of the bound material 27 along the first blade.receiving plate 16*a* is pressed against the first table element 16 by the first pressing plate 15*a*, and the portion of the bound material 27 along the second blade receiving plate 17*a* is pressed against the second table element 17 by the second pressing plate 15*b*. Almost simultaneously with this, the trimming cutter drive motor 22 is driven to descend the top edge trimming cutter 11 and the bottom edge trimming cutter 12, and the top edge 27*a* and the bottom edge 27*b* are cut and trimmed.

If the cutting operation at the first cutting position is completed, the grip head of the chuck mechanism 18 moves to the second cutting position while gripping the bound material 27 and then stops. At this moment, the front edge 27*c* of the bound material 27 is located on the third blade receiving plate 10*a* of the first portion 10 of the third table element. Thereafter, the pressing plate drive motor 26 is driven to descend the third pressing plate 15*c* and the portion of the bound material 27 along the third blade receiving plate 10*a* is pressed against the first portion 10 of the third table element. Almost simultaneously with this, the blade drive motor 22 is driven to descend the front edge trimming cutter 13 and the front edge 27*c* is cut and trimmed. If the cutting operation at the second cutting position is completed, the grip head of the chuck mechanism 8 returns to the bound material supply position while gripping the bound material. When the grip head returns to the bound material supply position, the movable block 18*b* of the grip head ascends and separates from the fixed block 18*a* and a state in which the bound material 27 is gripped by the grip head is released.

In this case, the movement and stop of the grip head of the chuck mechanism 18 and the driving and stop of the blade drive motor 22 and the pressing plate drive motor 26 are controlled by a controller which is not shown.

In the above-stated embodiment, by fixing the top edge cutting unit 19 and moving the bottom edge cutting unit 20 to the top edge cutting unit 19, the relative movement of the top edge trimming cutter 11 and the bottom edge trimming cutter 12, those of the corresponding first and second blade receiving plates 16*a* and 17*a* and those of the corresponding first and second pressing plates 15*a* and 15*b* are effected. Alternatively, these relative movement may be effected by moving the top edge cutting unit 19 to the fixed bottom edge cutting unit 20 or moving the top edge cutting unit 19 and the bottom edge cutting unit 20 in opposite directions. Further, in the above-stated embodiment, the cutting operation at the first cutting position and the cutting operation at the second cutting position are carried out in a staggered manner. Alternatively, these cutting operations may be simultaneously carried out.

As stated so far, in the three-side trimmer according to the present invention, as shown in FIG. 5, the positions at which the top and bottom edges of the bound material are cut differ from the position at which the front edge thereof is cut. Due to this, it is possible to avoid mechanical interference among the top edge trimming cutter, the bottom edge trimming cutter and the trimmed trimming cutter and to prevent the three-side trimmer from being broken. Further, it is possible to appropriately set the timing of the operations of the top edge trimming cutter and the bottom edge trimming cutter and the timing of the operation of the front edge trimming cutter. In addition, since the top edge trimming cutter and the corresponding first blade receiving plate and first pressing plate are attached to the first frame element, and the bottom edge trimming cutter and the corresponding second blade receiving plate and second pressing plate are attached to the second frame element, it suffices to relatively move the frame in accordance with the change of the size of the bound material without the need to replace the table elements and pressing plates, thereby making it possible to avoid dangerous operation. If the auxiliary pressing plate is attached to the grip head, the replacement of the auxiliary pressing plate can be safely, easily carried out at a position away from the cutting positions. Besides, the auxiliary pressing plate can be fitted to the cutting state of the bound material.

What is claimed is:

1. A three-side trimmer comprising:

a frame;

a cutting table supporting a bound material to be trimmed thereon;

a top edge trimming cutter attached to said frame for upward and downward movement, and cutting a top edge of said bound material;

a bottom edge trimming cutter attached to said frame for upward and downward movement and in parallel with said top edge trimming cutter, and cutting a bottom edge of said bound material;

a front edge trimming cutter attached to said frame for upward and downward movement at right angle with respect to said top edge trimming cutter and said bottom edge trimming cutter with predetermined distances from one ends of said top edge trimming cutter and said bottom edge trimming cutter, and cutting a front edge of said bound material;

a drive mechanism for effecting the upward and downward movement of said top edge trimming cutter, said bottom edge trimming cutter and said front edge trimming cutter;

first and second blade receiving plates attached to face said top edge trimming cutter and said bottom edge trimming cutter right under said top edge trimming cutter and said bottom edge trimming cutter, respectively on said cutting table for receiving blade edges of said top edge trimming cutter and said bottom edge trimming cutter, respectively;

a third blade receiving plate attached to face said front edge trimming cutter right under said front edge trimming cutter on said cutting table for receiving a blade edge of said front edge trimming cutter;

a pressing plate attached to said frame for upward and downward movement, and pressing said bound material against said cutting table;

said top edge trimming cutter and said bottom edge trimming cutter being arranged to move relatively to each other in a direction parallel to the length of said front edge trimming cutter in accordance with a size of said bound material;

said cutting table comprising first and second table elements movable relatively to each other along the direction of movement of said top edge trimming cutter and said bottom edge trimming cutter, and a stationary third table element;

first and second blade receiving plates attached to said first and second table elements, respectively, and a third blade receiving plate attached to said third table element; and a chuck mechanism gripping said bound material to be trimmed so as to move said bound material between at least two positions of a first cutting position at which said bound material is cut by said top edge trimming cutter and said bottom edge trimming cutter, and a second cutting position at which said bound material is cut by said front edge trimming cutter.

2. The three-side trimmer according to claim 1, wherein said frame comprises first and second frame elements movable relatively to each other along the direction of movement of said top edge trimming cutter and said bottom edge trimming cutter and a stationary third frame element; said top edge trimming cutter, said first table element and a first pressing plate pressing said bound material against said first table element and making an elevation movement are attached to said first frame element; said bottom edge trimming cutter, said second table element and a second pressing plate pressing said bound material against said second table element and making an elevation movement are attached to said second frame element; and relative movement of said first and second frame elements effect relative movement of said top edge trimming cutter and said bottom edge trimming cutter, relative movement of corresponding said first and second blade receiving plates and relative movement of corresponding said first and second pressing plates.

3. The three-side trimmer according to claim 2, wherein the relative movement of said first and second frame elements are effected by movement of said first and second frame elements in opposite directions or by movement of one of said first and second frame elements with respect to the other one of said first and second frame elements of its rest position.

4. The three-side trimmer according to claim 3, wherein said chuck mechanism is provided with an auxiliary pressing plate pressing said bound material against said third table element.

5. The three-side trimmer according to claim 1, wherein said chuck mechanism comprises a grip head consisting of a fixed block and a movable block coupled to the fixed block through a vertical screw shaft so as to ascend and descend by rotation of said screw shaft, a motor attached to the lower portion of said fixed block for rotating said vertical screw shaft about its axis, a horizontal screw shaft and a guide rod attached to said frame and arranged parallel with each other along a direction parallel to the length of said top edge trimming cutter and bottom edge trimming cutter, said fixed block being provided with two penetrating holes in a direction parallel to the length of said top edge trimming cutter and bottom edge trimming cutter, one of said penetrating holes being provided with an internal thread for engaging with said horizontal screw shaft, said horizontal screw shaft being screwed into said one of the penetrating holes, said guide rod being inserted into other of the penetrating holes, a shaft driving motor fixed to said frame, a first pulley mounted on one end of said horizontal screw shaft, a second pulley mounted on a drive shaft of said shaft driving motor, and an endless belt engaged with said first and second pulleys, wherein said grip head grips said bound material between its fixed block and movable block, and executes slide movement along the guide rod at least between said first cutting position and said second cutting position.

6. The three-side trimmer according to claim 2, wherein said chuck mechanism comprises a grip head consisting of a fixed block and a movable block coupled to the fixed block through a vertical screw shaft so as to ascend and descend by rotation of said screw shaft, a motor attached to the lower portion of said fixed block for rotating said vertical screw shaft about its axis, a horizontal screw shaft and a guide rod attached to said frame and arranged parallel with each other along a direction parallel to the length of said top edge trimming cutter and bottom edge trimming cutter, said fixed block being provided with two penetrating holes in a direction parallel to the length of said top edge trimming cutter and bottom edge trimming cutter, one of said penetrating holes being provided with an internal thread for engaging with said horizontal screw shaft, said horizontal screw shaft being screwed into said one of the penetrating holes, said guide rod being inserted into other of the penetrating holes, a shaft driving motor fixed to said frame, a first pulley mounted on one end of said horizontal screw shaft, a second pulley mounted on a drive shaft of said shaft driving motor, and an endless belt engaged with said first and second pulleys, wherein said grip head grips said bound material between its fixed block and movable block, and executes slide movement along the guide rod at least between said first cutting position and said second cutting position.

7. The three-side trimmer according to claim 3, wherein said chuck mechanism comprises a grip head consisting of a fixed block and a movable block coupled to the fixed block through a vertical screw shaft so as to ascend and descend by rotation of said screw shaft, a motor attached to the lower portion of said fixed block for rotating said vertical screw shaft about its axis, a horizontal screw shaft and a guide rod attached to said frame and arranged parallel with each other along a direction parallel to the length of said top edge trimming cutter and bottom edge trimming cutter, said fixed block being provided with two penetrating holes in a direction parallel to the length of said top edge trimming cutter and bottom edge trimming cutter, one of said penetrating holes being provided with an internal thread for engaging with said horizontal screw shaft, said horizontal screw shaft being screwed into said one of the penetrating holes, said guide rod being inserted into other of the penetrating holes, a shaft driving motor fixed to said frame, a first pulley mounted on one end of said horizontal screw shaft, a second pulley mounted on a drive shaft of said shaft driving motor, and an endless belt engaged with said first and second pulleys, wherein said grip head grips said bound material between its fixed block and movable block, and executes slide movement along the guide rod at least between said first cutting position and said second cutting position.

8. The three-side trimmer according to claim 4, wherein said chuck mechanism comprises a grip head consisting of a fixed block and a movable block coupled to the fixed block through a vertical screw shaft so as to ascend and descend by rotation of said screw shaft, a motor attached to the lower portion of said fixed block for rotating said vertical screw shaft about its axis, a horizontal screw shaft and a guide rod attached to said frame and arranged parallel with each other along a direction parallel to the length of said top edge trimming cutter and bottom edge trimming cutter, said fixed block being provided with two penetrating holes in a direction parallel to the length of said top edge trimming cutter and bottom edge trimming cutter, one of said penetrating holes being provided with an internal thread for engaging with said horizontal screw shaft, said horizontal screw shaft being screwed into said one of the penetrating holes, said guide rod being inserted into other of the penetrating holes, a shaft driving motor fixed to said frame, a first pulley mounted on one end of said horizontal screw shaft, a second pulley mounted on a drive shaft of said shaft driving motor, and an endless belt engaged with said first and second pulleys, wherein said grip head grips said bound material between its fixed block and movable block, and executes slide movement along the guide rod at least between said first cutting position and said second cutting position.

* * * * *